US007155943B1

(12) United States Patent
Lin

(10) Patent No.: US 7,155,943 B1
(45) Date of Patent: Jan. 2, 2007

(54) COMBINATION LOCK AND PADLOCK COMBINATION WITH MECHANISM FOR VISUALLY INDICATING KEY OPENING PERMISSION

(76) Inventor: Chu Pao-Feng Lin, No. 3, Lane 88, Sec. 1, Jhongsing Rd., Wugu Township, Taipei County (TW)

( * ) Notice: Subject to any disclaimer, the term of this patent is extended or adjusted under 35 U.S.C. 154(b) by 0 days.

(21) Appl. No.: 11/317,068

(22) Filed: Dec. 22, 2005

(51) Int. Cl.
*E05B 37/02* (2006.01)

(52) U.S. Cl. ..... 70/21; 70/25; 70/284; 70/285; 70/432

(58) Field of Classification Search ..... 70/21, 70/25, 26, 38 R, 38 A, 38 B, 284, 285, DIG. 63, 70/DIG. 71, 431, 432, 435, 437, 441
See application file for complete search history.

(56) References Cited

U.S. PATENT DOCUMENTS 6,848,283 B1 * 2/2005 Lin ..... 70/21
2004/0226323 A1 * 11/2004 Ling et al. ..... 70/25
2004/0226324 A1 * 11/2004 Loughlin et al. ..... 70/25
2005/0132762 A1 * 6/2005 Yu ..... 70/25
2005/0262902 A1 * 12/2005 Ling et al. ..... 70/21
2006/0107708 A1 * 5/2006 Yu ..... 70/21
2006/0107709 A1 * 5/2006 Yu ..... 70/21
2006/0107710 A1 * 5/2006 Yu ..... 70/25

* cited by examiner

*Primary Examiner*—Lloyd A. Gall
(74) *Attorney, Agent, or Firm*—Pro-Techtor Int'l Services

(57) ABSTRACT

A combination lock and padlock combination for visually indicating a key opening permission being allowed or not is disclosed. A wheel includes two opposite projections on one end surface, spaced protuberances on the other end surface, two opposite key opening marks provided on an outer surface, and an annular flange proximate the protuberances, the flange being partially exposed. In response to turning the wheel to conceal the marks, a co-owner is aware that a key opening mechanism is disabled. Also, forcedly inserting a key into the key opening mechanism for opening the combination will be futile since a downward movement path of a protrusion on a spring biased shuttle assembly is blocked by the lower projection even if an engagement member of the key opening mechanism is aligned with mated bottom legs of the shuttle assembly.

2 Claims, 9 Drawing Sheets

COMBINATION LOCK AND PADLOCK COMBINATION WITH MECHANISM FOR VISUALLY INDICATING KEY OPENING PERMISSION

BACKGROUND OF THE INVENTION

1. Field of Invention

The present invention relates to combination lock and padlock combinations and more particularly to a combination lock and padlock combination having a wheel with two opposite surface marks such that exposing the marks by turning the wheel will indicate a co-owner of the lock not to attempt to open the lock by key since the key opening mechanism is disabled temporarily.

2. Related Art

As evidenced by a large number of prior art patents, efforts are continuing to improve locks particularly combination lock and padlock combinations. For example, U.S. Pat. No. 6,848,283B1 discloses a combination lock capable of being opened by a key or inhibited the same and the subject matter of which is incorporated by reference into the present invention. Only drawback of which is that a co-owner of the lock is not aware whether a key opening mechanism of the lock is enabled or disabled. Thus, it is possible that a co-owner of the lock may attempt to open the lock by key. Unfortunately, the attempt is futile since the key opening mechanism is already disabled temporarily by another co-owner of the lock. It is sometimes bothersome. Thus, the need for improvement still exists.

SUMMARY OF THE INVENTION

It is therefore an object of the present invention to provide a combination lock and padlock combination for visually indicating a key opening permission being allowed or not, comprising a housing including an internal cavity proximate one side having a top opening and a bottom opening respectively, an internal recess provided adjacent the top opening, front and rear openings aligned with the recess, and front and rear slits adjacent the front and the rear openings; a U-shaped shackle including a long leg, a short leg, and a tab provided on the long leg; a tumbler wheel assembly rotatably formed on the long leg and including a plurality of tumbler wheels partially projected from the housing, each tumbler wheel having a plurality of indicia formed thereon; a key opening mechanism provided in the cavity and including a peripheral ridge, a bottom keyhole, a central shaft, and a top engagement member; a spring biased shuttle assembly including a top bore, an intermediate protrusion, and a projecting bottom member; and a wheel rotatably provided in the recess and including two opposite projections provided on one end surface, a plurality of equally spaced apart protuberances provided on the other end surface, two opposite key opening marks provided on an outer surface, and an annular flange provided on the outer surface proximate the protuberances, the flange being partially projected from the slits; wherein in a locked position of the combination with the key opening marks being exposed, an upper portion of the shuttle assembly is projected from a top of the housing, a terminating end of the short leg is fastened in the bore, the projections are disposed in a position other than above or below the protrusion, and the tab is disposed in a position between any two adjacent protuberances; whereby in response to exposing the key opening marks and the locked position of the combination inserting a key into the key hole and turning the key to rotate the engagement member until the engagement member and the bottom member are about to matingly engage will suddenly release a stored compression force of the shuttle assembly to push the bottom member downward to matingly engage with the engagement member, move the protrusion downward to pass a virtual line connecting the projections, and dispose a terminating end of the short leg above an opening of the bore by a predetermined distance sufficient to open the combination; turning the dials until a correct combination of the dials is formed and pulling the terminating end of the short leg out of the bore will open the combination wherein the protrusion is disposed below the projections, the terminating end of the short leg is disposed further above the opening of the bore, and the tab is disposed above a top of the housing for allowing a free turning of the wheel; in response to an unlocked position of the combination, the terminating end of the short leg disposed further above the opening of the bore, and the tab disposed above the top of the housing turning either flange to dispose the key opening marks in a position from being seen externally of the housing will cause the lower projection to block a downward movement path of the protrusion, pressing the shackle until the terminating end of the short leg is fastened in the bore, and turning the dials to a combination other than the correct one will dispose the tab in a position between any two adjacent protuberances, lock the combination, and disable the key opening mechanism.

In one aspect of the present invention the number of the protuberances is four.

The above and other objects, features and advantages of the present invention will become apparent from the following detailed description taken with the accompanying drawings.

BRIEF DESCRIPTION OF THE DRAWINGS

FIG. 2-1 is a perspective view of the wheel;

DETAILED DESCRIPTION OF THE INVENTION

Figure 1:
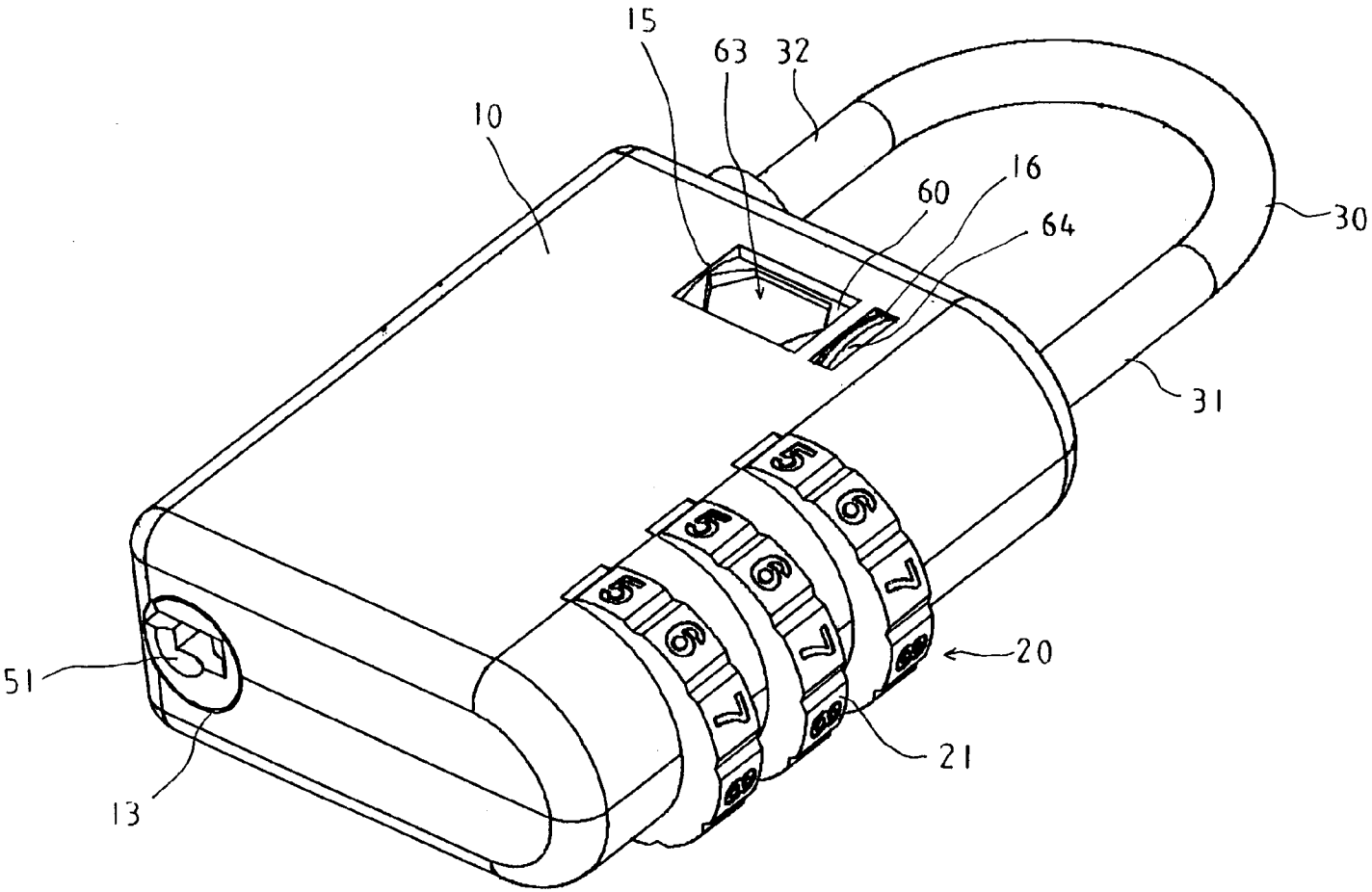
FIG. 1 is a perspective view of a preferred embodiment of combination lock and padlock combination according to the invention where marks (only one is shown) are exposed for indicating a key opening mechanism being enabled.
Figure 2:
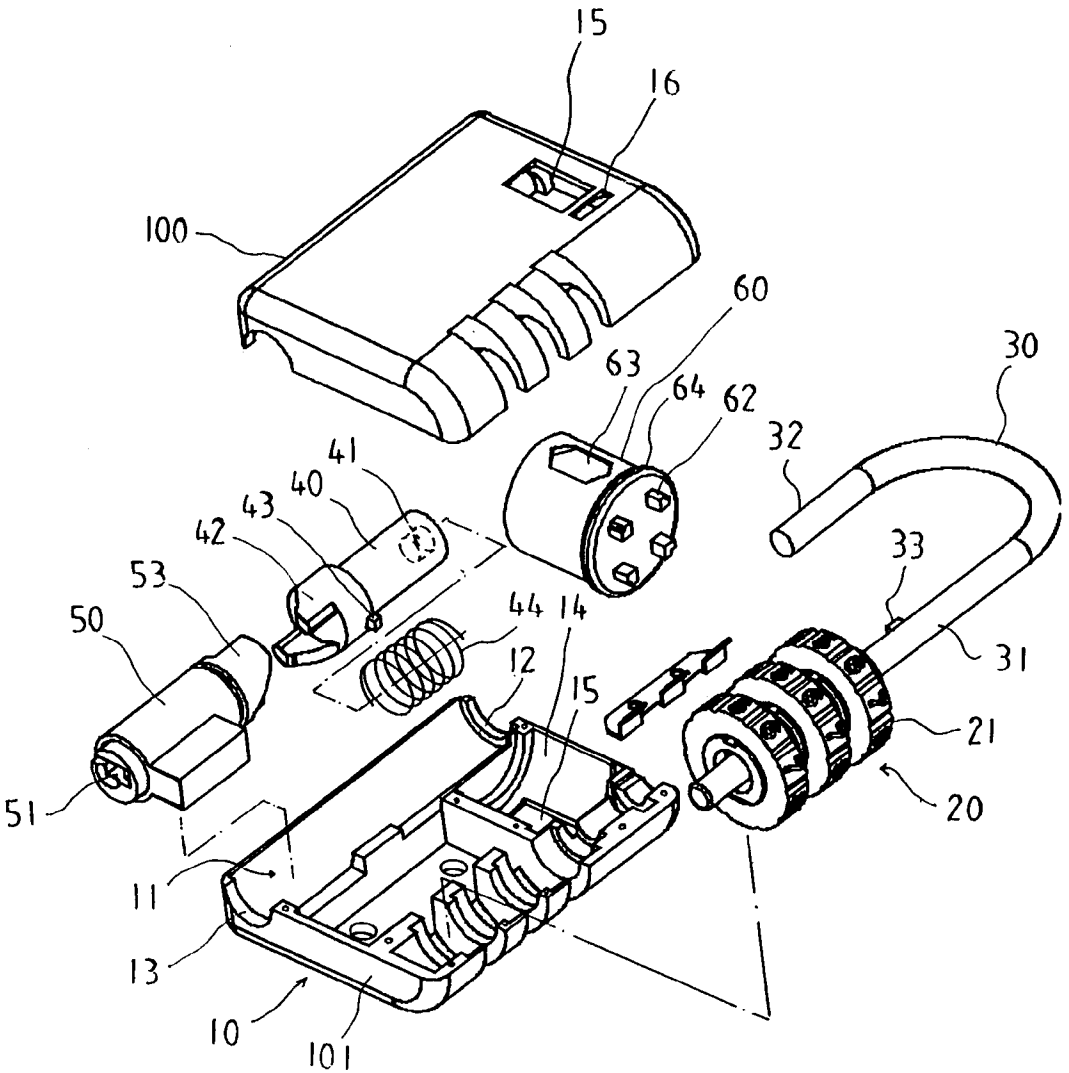
FIG. 2 is an exploded view of the combination.
Figures 1, 2:
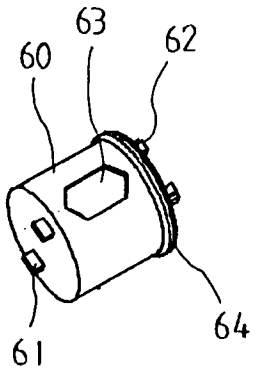

Referring to FIGS. 1 to 9, a combination lock and padlock combination (i.e., lock) in accordance with a preferred embodiment of the invention is shown. The combination comprises a substantially parallelepiped housing 10 consisting of an upper shell 100 and a mated a lower shell 101. The housing 10 comprises a cylindrical cavity 11 proximate one side having a top opening 12 and a bottom opening 13 respectively, a recess 14 adjacent the top opening 12, front and rear openings 15 aligned with the recess 14, and front and rear slits 16 adjacent the openings 15 also aligned with the recess 14.

The combination further comprises a U-shaped shackle 30 including a long leg 31, a short leg 32, and a tab 33 provided on the long leg 31; a tumbler wheel assembly 20 rotatably formed on a lower portion of the long leg 31 and including three tumbler wheels 21 anchored in a series of (e.g., three) substantially half-circular openings on the housing 10 being in communication with the external, each tumbler wheel 21 having a plurality of indicia formed thereon; and a cylindrical key opening mechanism 50 provided in the cavity 11 and including a rectangular side ridge, a bottom keyhole 51, a central shaft 52, and a top engagement member 53.

The combination further comprises a staged shuttle assembly 40 including a top cylindrical bore 41, a protrusion 43 provided on a shoulder between its upper portion and its lower portion, two bottom legs 42 capable of matingly engaging with the engagement member 53, and a spring (e.g., coil spring) 44 biased between the shoulder and an inner wall of the cavity 11 proximate the top opening 12; and a cylindrical wheel 60 rotatably provided in the recess 14 and including two opposite projections 61 provided on one end surface, four equally spaced apart protuberances 62 provided on the other end surface, two opposite marks 63 provided on an outer surface, and an annular flange 64 provided on the outer surface proximate the protuberances 62, the flange 64 being partially projected from the slits 16.

Figure 3:
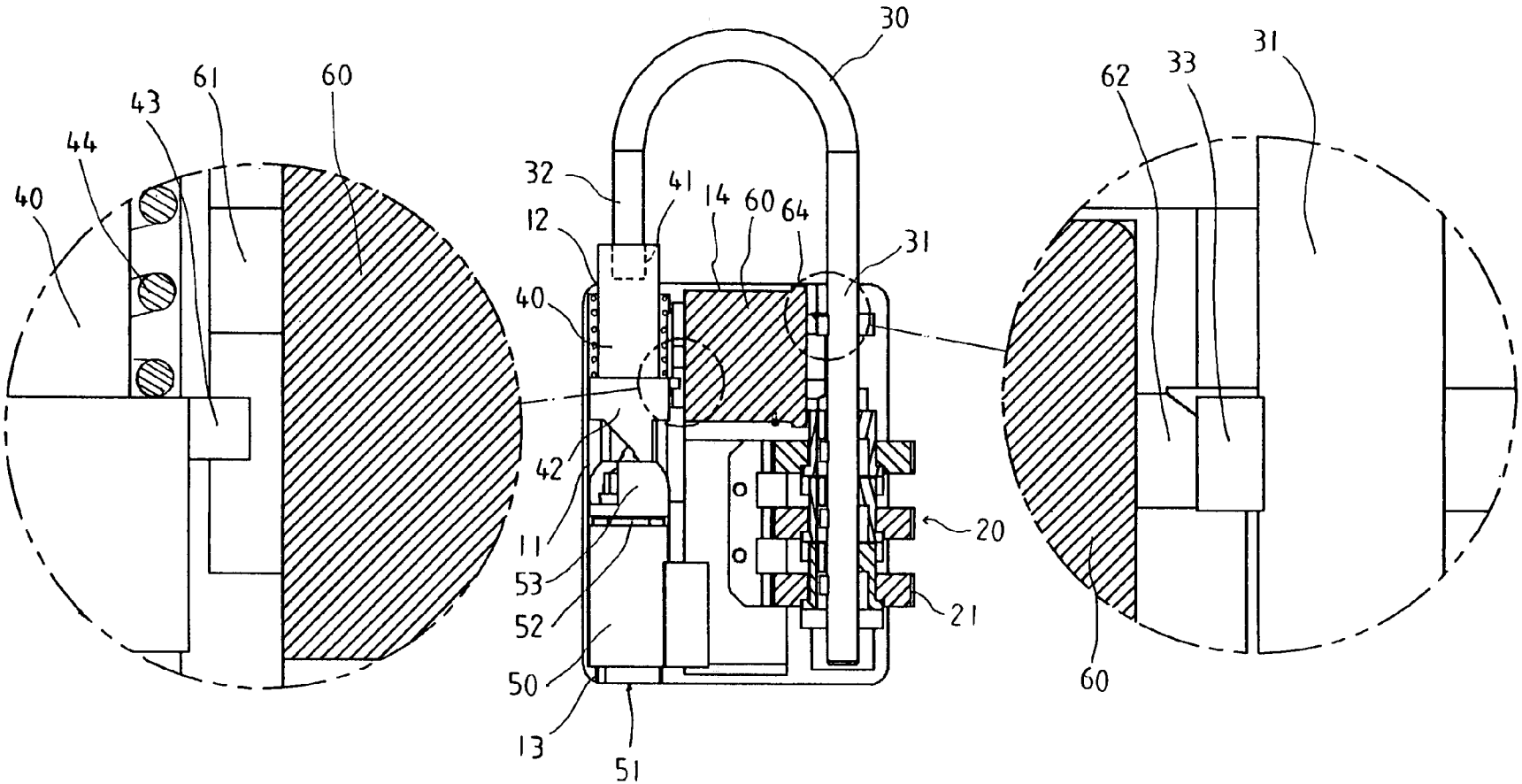
FIG. 3 is a transverse sectional view of the combination with portions enlarged for showing its details where the lock is locked.

Following is a detailed description of the opening and locking operations of the lock of the invention. As shown in FIG. 3, in a locked state of the lock with a key opening permission being allowed (i.e., the marks 63 are exposed), an upper portion of the shuttle assembly 40 is projected from a top of the housing 10 with a terminating end of the short leg 32 being fastened in the bore 41. Also, the projections 61 are disposed in a position other than above or below the protrusion 43 (see left side of FIG. 3) and the tab 33 is disposed in a position between any two adjacent protuberances 62 (see right side of FIG. 3). At this position, it is impossible of turning horizontally the shackle 30 about the housing 10. Further, it is impossible of pulling the shackle 30 upward since a longitudinal movement of the long leg 31 is locked by the tumbler wheel assembly 20 (i.e., an incorrect combination being formed by the dials 21).

Figure 4:
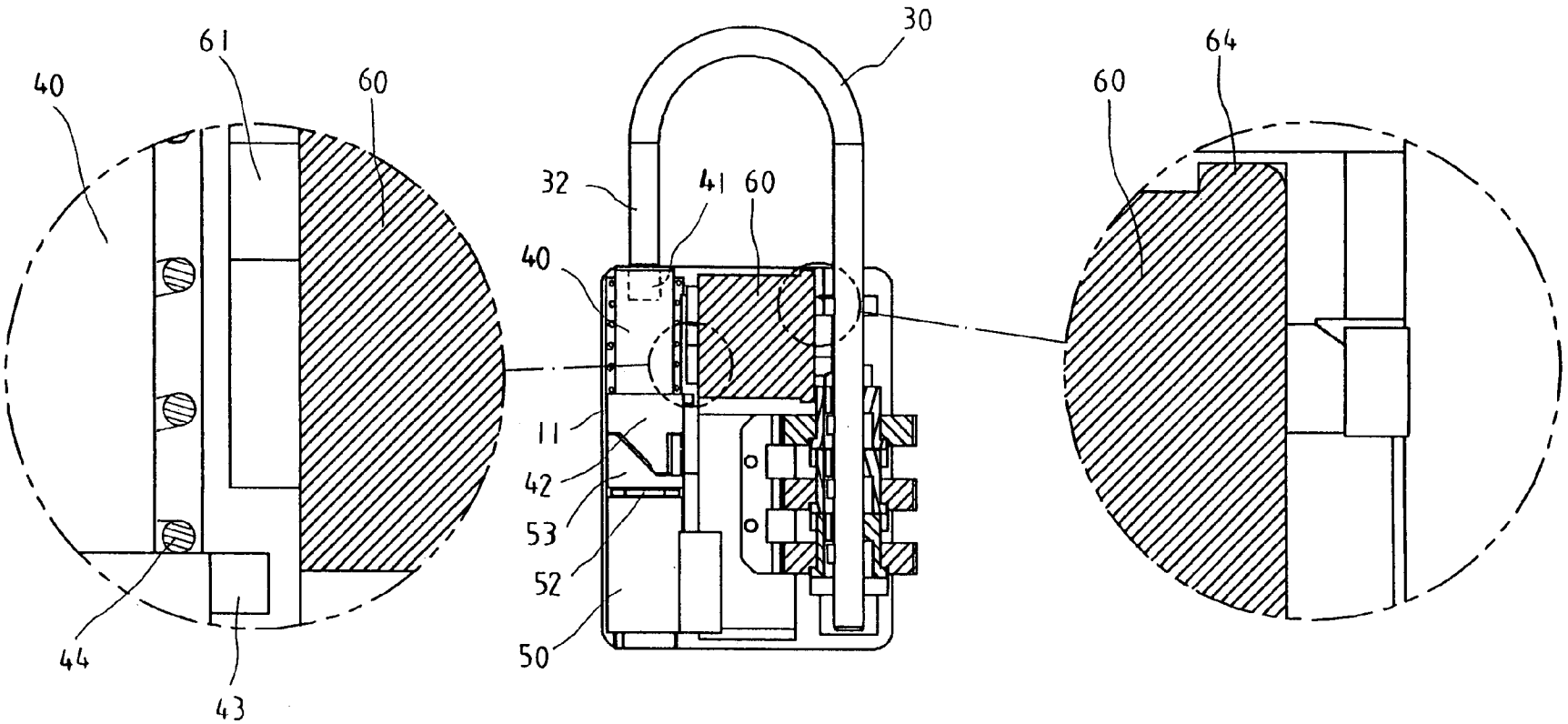
FIG. 4 is a view similar to FIG. 3, where the lock is opened by key.

As shown in FIG. 4, for opening the lock in a condition of the key opening permission being allowed a user may insert a key (not shown) into the key hole 51 and then turn the key to rotate the engagement member 53 until the engagement member 53 and the bottom legs 42 are about to matingly engage. At this position, the stored compression force of the spring 44 is suddenly released to push the bottom legs 42 downward for matingly engaging the bottom legs 42 with the engagement member 53. Also, the protrusion 43 moves downward to pass a virtual line connecting the projections 61 (see left side of FIG. 4) and the terminating end of the short leg 32 is disposed above the opening of the bore 41 (see intermediate portion of FIG. 4). At this position, the lock is open.

Figure 5:
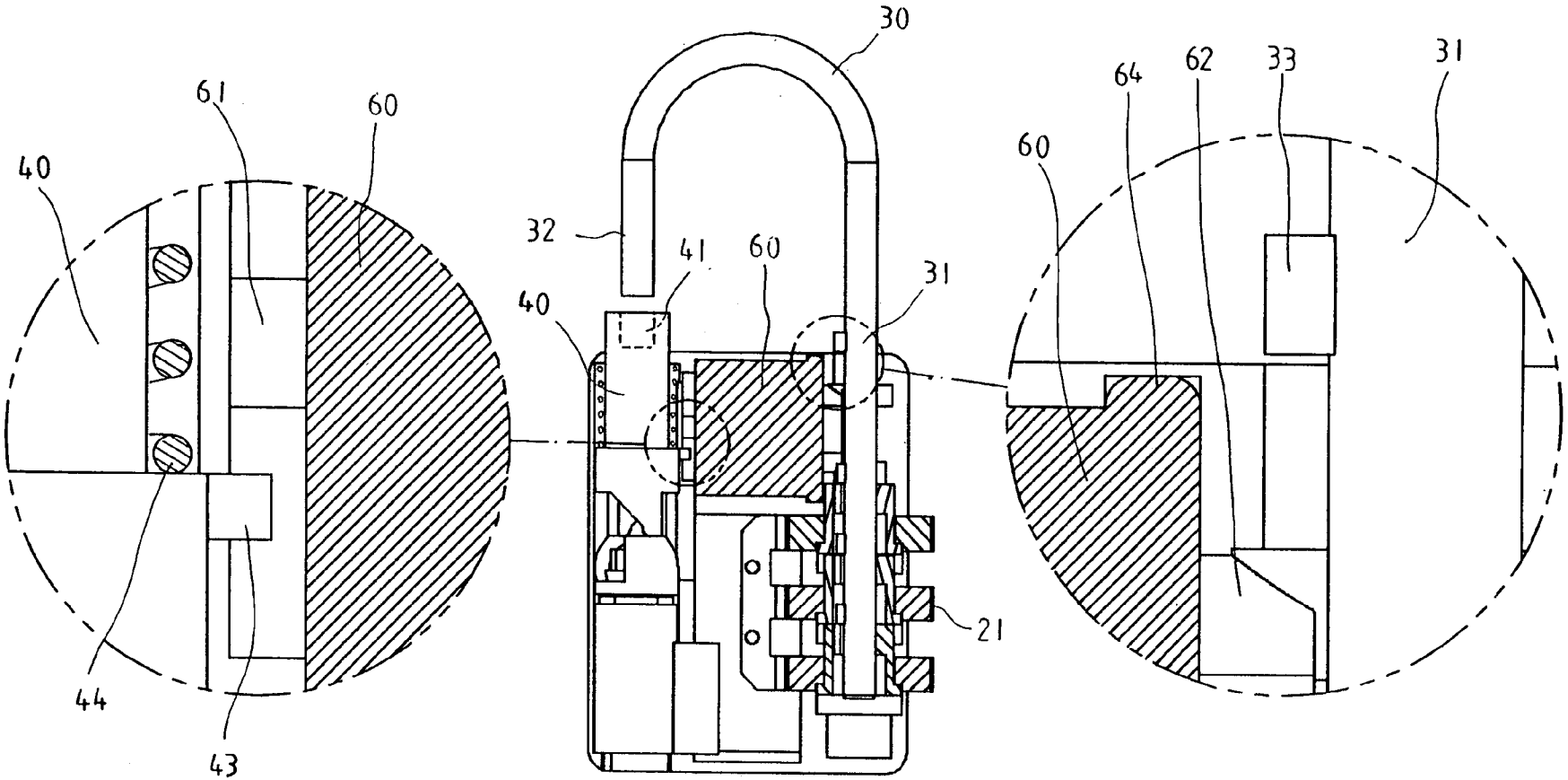
FIG. 5 is a view similar to FIG. 3, where the lock is opened by turning dials to a correct combination.

Alternatively, as shown in FIG. 5, for opening the lock a user may turn the dials 21 until a correct combination of the dials 21 is formed. Next, pull the terminating end of the short leg 32 out of the bore 41 since the longitudinal movement of the long leg 31 is unlocked by the tumbler wheel assembly 20 (i.e., the lock is open). At the unlocked position, the protrusion 43 is disposed below the projections 61 (see left side of FIG. 5), the terminating end of the short leg 32 is disposed further above the opening of the bore 41 (see intermediate portion of FIG. 5), and the tab 33 is disposed above a top of the housing 10 (i.e., turning the wheel 60 being allowed as shown in right side of FIG. 5).

Figure 6:
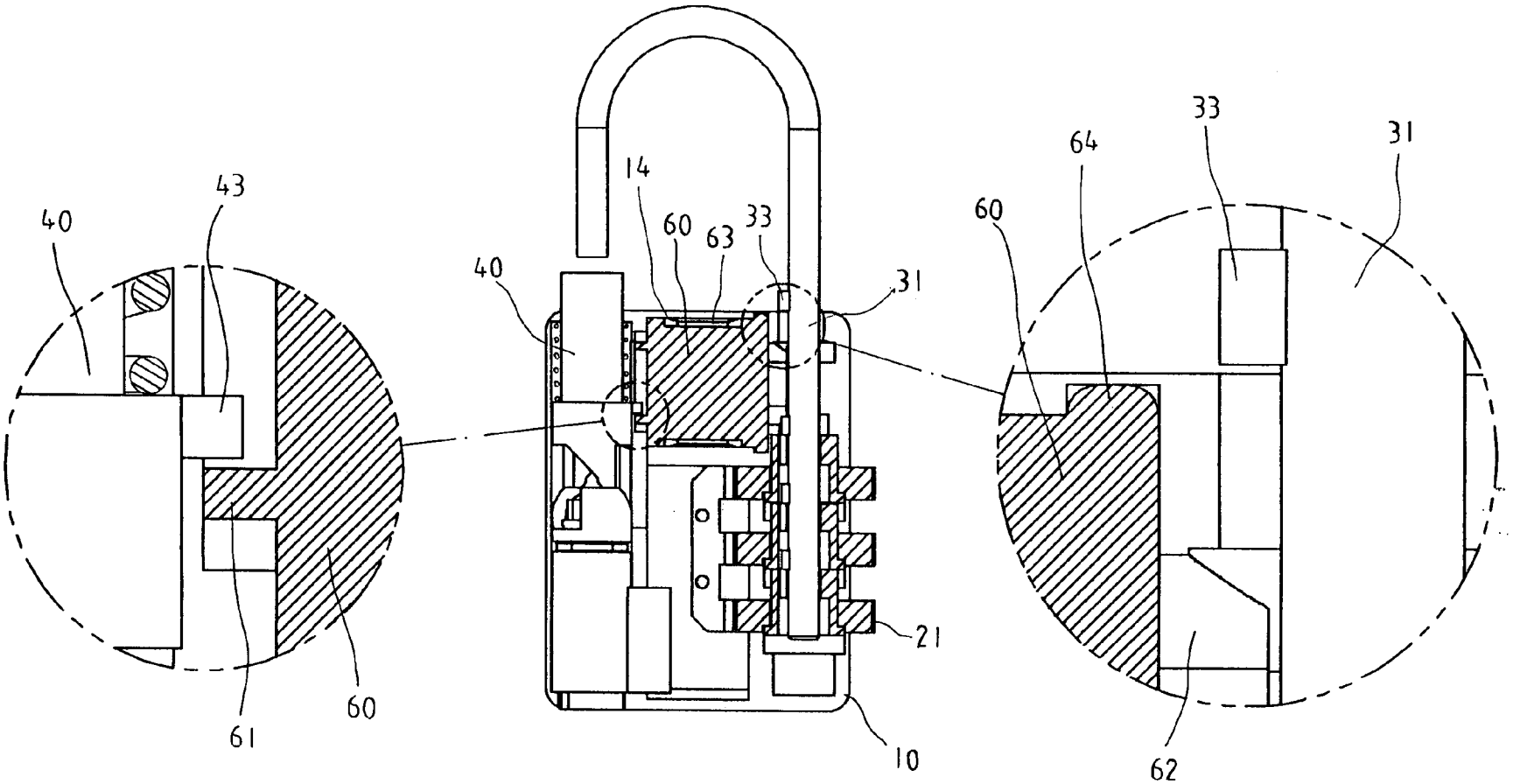
FIG. 6 is a view similar to FIG. 5, where the marks are concealed by turning the wheel.
Figure 7:
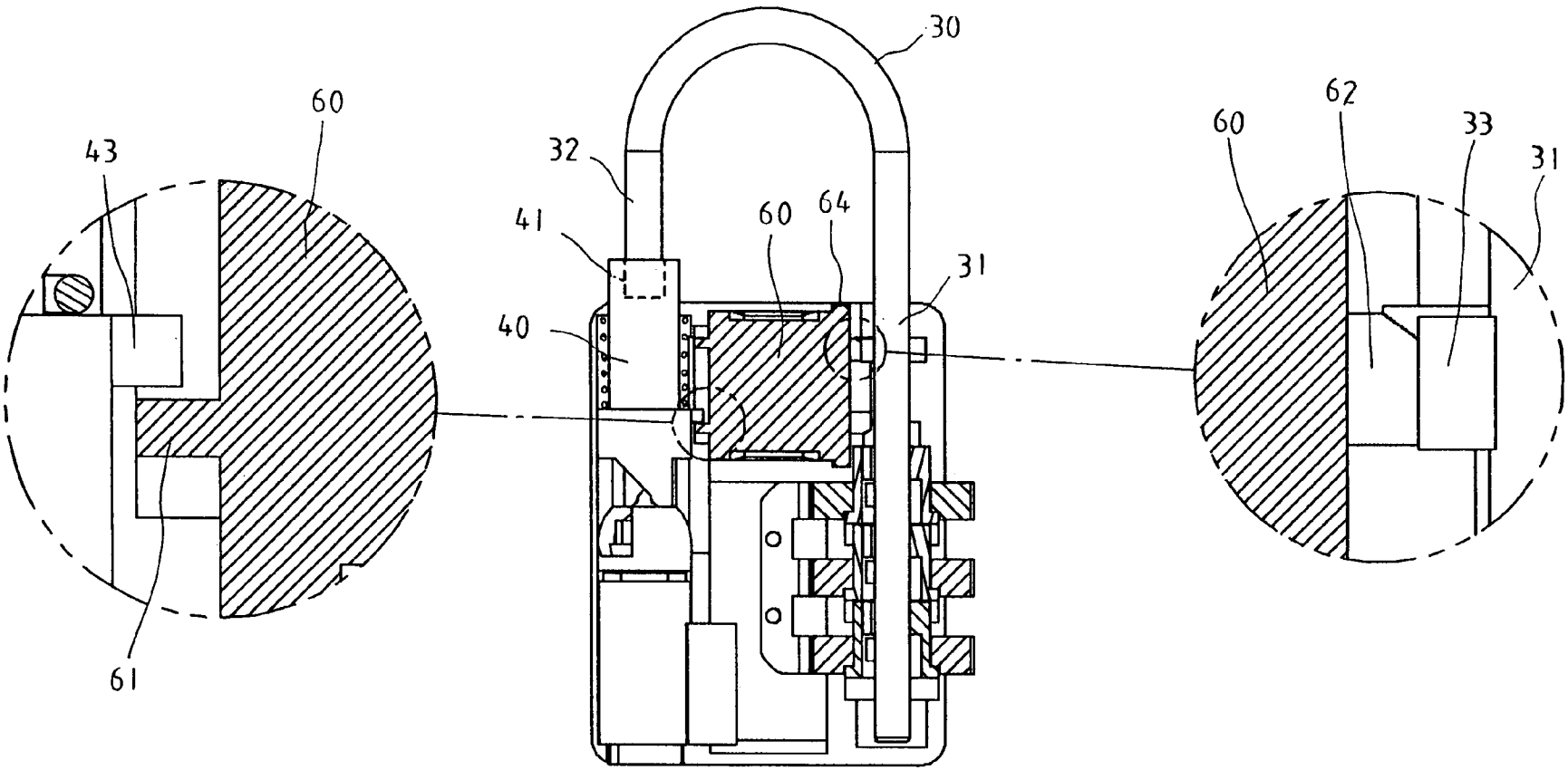
FIG. 7 is a view similar to FIG. 6, where the lock is locked and the key opening mechanism is disabled.
Figure 8:
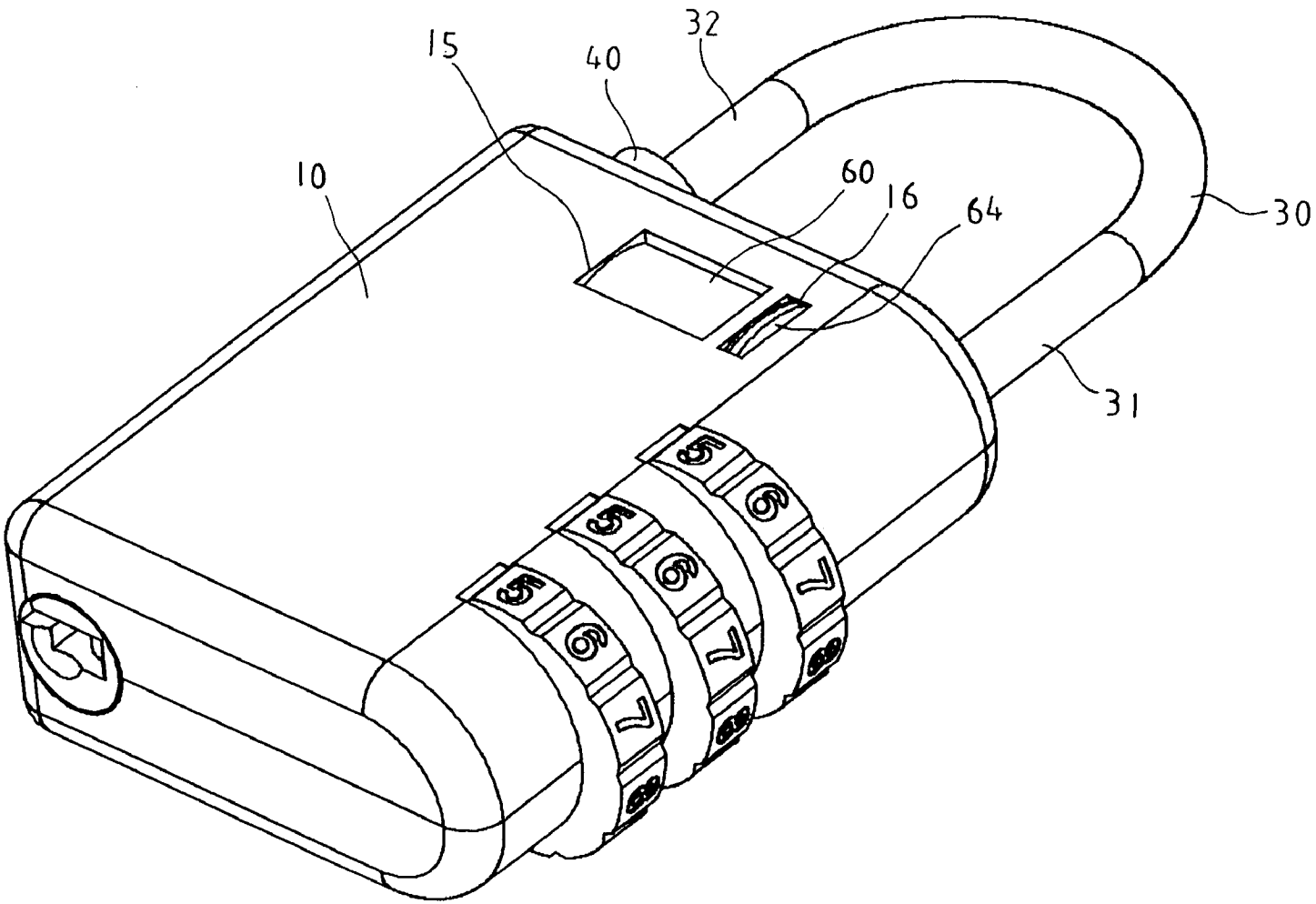
FIG. 8 is a view similar to FIG. 1, where the marks are concealed for indicating the key opening mechanism being disabled.
Figure 9:
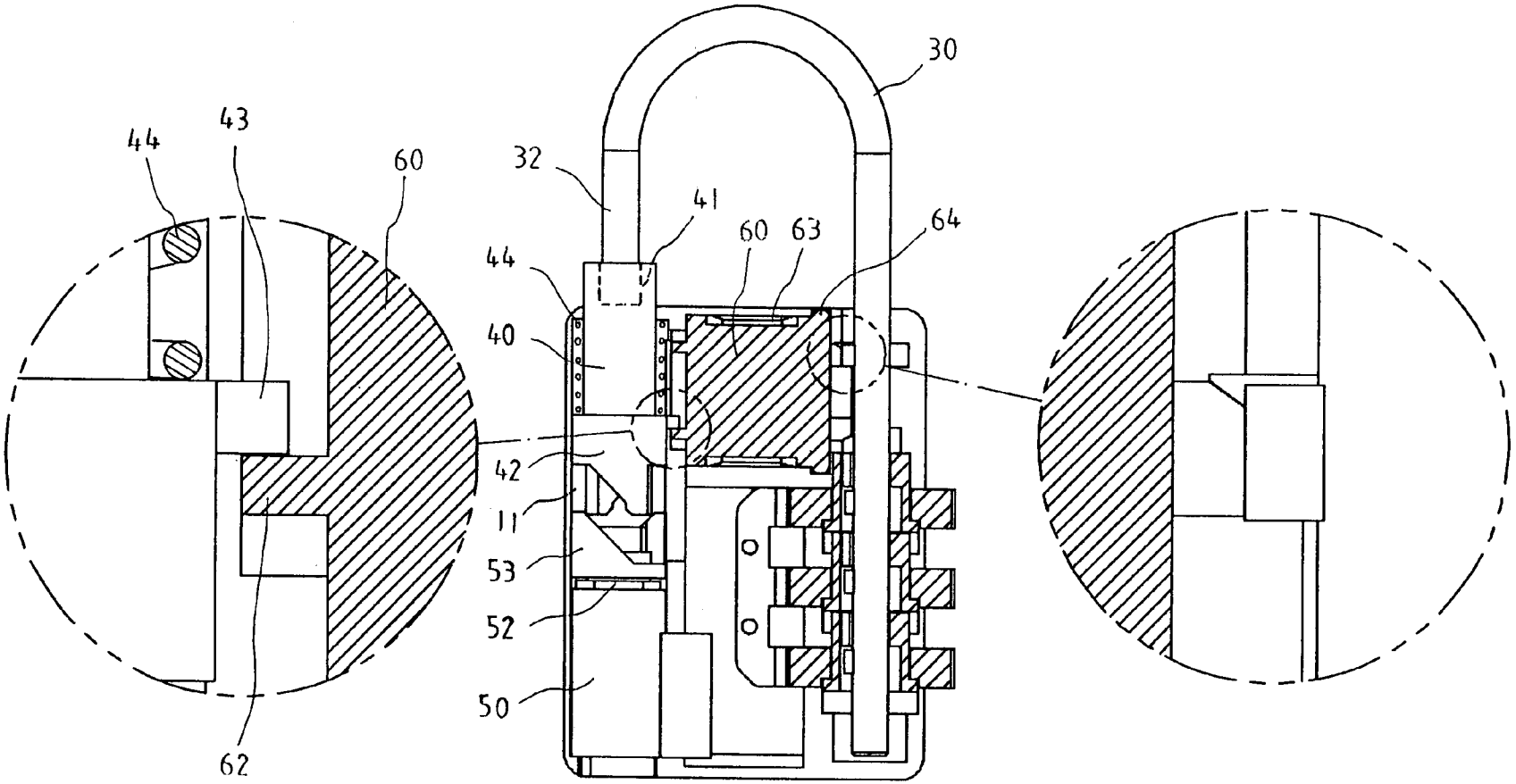
FIG. 9 is a view similar to FIG. 7 for illustrating a futile attempt of opening the lock by inserting a key into the key opening mechanism since the key opening mechanism is already disabled.

As shown in FIG. 1, the marks 63 are exposed (only one is shown) and thus all co-owners of the lock are allowed to open the lock by a key or by rotating the dials 21 to a correct combination. To the contrary, as shown in FIGS. 6, 7, and 8, in an unlocked position of the lock with the terminating end of the short leg 32 disposed further above the opening of the bore 41 (see intermediate portion of FIG. 6) and the tab 33 disposed above the top of the housing 10 (see right side of FIG. 6), an owner may temporarily disable the key opening mechanism 50 (i.e., opening the lock by key by a co-owner being not allowed) by performing operations of turning the flange 64 to conceal the marks 63 as shown FIG. 8. At this position, the downward movement path of the protrusion 43 is blocked by the lower projection 61 (see left side of FIG. 6). Next, the user may press the shackle 30 until the terminating end of the short leg 32 is fastened in the bore 41. Finally, the user may turn the dials 21 to a combination other than a correct one. At this position, the lock is locked as shown in FIG. 7 with the tab 33 being disposed in a position between any two adjacent protuberances 62 (see right side of FIG. 7).

The co-owner of the lock will not attempt to open the lock by key since he or she cannot see the marks 63. That is, the co-owner of the lock is aware that the key opening mechanism 50 is disabled temporarily. Obviously, forcedly inserting a key into the key opening mechanism 50 for opening the lock will be futile since the downward movement path of the protrusion 43 is blocked by the lower projection 61 even if the engagement member 53 is aligned with the bottom legs 42 (see left side of FIG. 9).

While the invention herein disclosed has been described by means of specific embodiments, numerous modifications and variations could be made thereto by those skilled in the art without departing from the scope and spirit of the invention set forth in the claims.

What is claimed is:

1. A combination lock and padlock combination for visually indicating a key opening permission being allowed or not, comprising:

a housing including an internal cavity proximate one side having a top opening and a bottom opening respectively, an internal recess provided adjacent the top opening, front and rear openings aligned with the recess, and front and rear slits adjacent the front and the rear openings;

a U-shaped shackle including a long leg, a short leg, and a tab provided on the long leg;

a tumbler wheel assembly rotatably formed on the long leg and including a plurality of tumbler wheels partially projected from the housing, each tumbler wheel having a plurality of indicia formed thereon;

a key opening mechanism provided in the cavity and including a peripheral ridge, a bottom keyhole, a central shaft, and a top engagement member;

a spring biased shuttle assembly including a top bore, an intermediate protrusion, and a projecting bottom member; and a wheel rotatably provided in the recess and including two opposite projections provided on one end surface, a plurality of equally spaced apart protuberances provided on the other end surface, two opposite key opening marks provided on an outer surface, and an annular flange provided on the outer surface proximate the protuberances, the flange being partially projected from the slits;

wherein in a locked position of the combination with the key opening marks being exposed, an upper portion of the shuttle assembly is projected from a top of the housing, a terminating end of the short leg is fastened in the bore, the projections are disposed in a position other than above or below the protrusion, and the tab is disposed in a position between any two adjacent protuberances;

whereby in response to exposing the key opening marks and the locked position of the combination inserting a key into the keyhole and turning the key to rotate the engagement member until the engagement member and the bottom member are about to matingly engage will suddenly release a stored compression force of the shuttle assembly to push the bottom member downward to matingly engage with the engagement member, move the protrusion downward to pass a virtual line connecting the projections, and dispose a terminating end of the short leg above an opening of the bore by a predetermined distance sufficient to open the combination;

turning the dials until a correct combination of the dials is formed and pulling the terminating end of the short leg out of the bore will open the combination wherein the protrusion is disposed below the projections, the terminating end of the short leg is disposed further above the opening of the bore, and the tab is disposed above a top of the housing for allowing a free turning of the wheel;

in response to an unlocked position of the combination, the terminating end of the short leg disposed further above the opening of the bore, and the tab disposed above the top of the housing turning either flange to dispose the key opening marks in a position from being seen externally of the housing will cause the lower projection to block a downward movement path of the protrusion, pressing the shackle until the terminating end of the short leg is fastened in the bore, and turning the dials to a combination other than the correct one will dispose the tab in a position between any two adjacent protuberances, lock the combination, and disable the key opening mechanism.

2. The combination lock and padlock combination of claim 1, wherein the number of the protuberances is four.

* * * * *